US007011349B2

(12) United States Patent
Nomura et al.

(10) Patent No.: US 7,011,349 B2
(45) Date of Patent: Mar. 14, 2006

(54) VEHICLE DOOR HANDLE DEVICE

(75) Inventors: Morihito Nomura, Chiryu (JP); Kouji Ooe, Nagoya (JP); Kouichi Nagata, Obu (JP); Atsushi Kamiya, Kariya (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 10/845,261

(22) Filed: May 14, 2004

(65) Prior Publication Data

US 2004/0217602 A1 Nov. 4, 2004

Related U.S. Application Data

(62) Division of application No. 10/042,309, filed on Jan. 11, 2002.

(30) Foreign Application Priority Data

Jan. 11, 2001 (JP) ..... 2001-004020
Jan. 31, 2001 (JP) ..... 2001-022566

(51) Int. Cl.
*E05B 1/00* (2006.01)

(52) U.S. Cl. ..... 292/347; 292/DIG. 64

(58) Field of Classification Search ..... 292/336.3, 292/347, DIG. 53, DIG. 64; 16/412
See application file for complete search history.

(56) References Cited

U.S. PATENT DOCUMENTS 4,482,179 A 11/1984 Johnson
4,883,296 A 11/1989 Laurie
5,685,581 A 11/1997 Kritzler et al.
5,725,262 A * 3/1998 Kritzler ..... 292/336.3
5,791,703 A 8/1998 Kritzler et al.
5,860,684 A 1/1999 Mizuki
5,887,918 A * 3/1999 Okada et al. ..... 292/336.3
6,007,122 A * 12/1999 Linder et al. ..... 292/336.3
6,073,397 A * 6/2000 Tanimoto et al. ..... 49/460
6,234,548 B1 5/2001 Mittelbach et al.
6,239,693 B1 5/2001 Benard et al.
6,363,577 B1 * 4/2002 Spitzley ..... 292/336.3
6,401,302 B1 6/2002 Josserand et al.
6,415,636 B1 7/2002 Fukumoto et al.
6,447,030 B1 9/2002 Meinke
6,523,871 B1 2/2003 Josserand
6,543,090 B1 4/2003 Muneta
6,612,630 B1 * 9/2003 Meinke ..... 292/348

FOREIGN PATENT DOCUMENTS

JP 6-7188 Y2 2/1994
JP 2002-179192 A 6/2000

* cited by examiner

*Primary Examiner*—Gary Estremsky
(74) *Attorney, Agent, or Firm*—Buchanan Ingersoll PC

(57) ABSTRACT

A vehicle door handle device includes a frame equipped on a vehicle door panel and a handgrip mounted on the frame and rotatable about a rotation center portion at one end portion of the handgrip. A second end portion of the handgrip forms an operation portion linked with a door lock mechanism. The handgrip is adapted to be rotated within a predetermined angle around the rotation center portion to operate the door lock mechanism when the operation portion is pulled away from the frame. A restriction mechanism is also provided to restrict chattering and/or dislocation of the handgrip from the frame. The restriction mechanism includes a projection and a groove provided between the frame and the handgrip. The projection is slidable in the groove during rotation of the handgrip and is able to contact a boundary of the groove in the inserting direction of the handgrip.

8 Claims, 7 Drawing Sheets

VEHICLE DOOR HANDLE DEVICE

This application is a divisional application of application Ser. No. 10/042,309 filed on Jan. 11, 2002.

This application is based on and claims priority under 35 U.S.C. § 119 with respect to Japanese Application No. 2001-004020 filed on Jan. 11, 2001 and Japanese Application No. 200-022566 filed on Jan. 31, 2001, the entire content of both of which is incorporated herein by reference.

FIELD OF THE INVENTION

This invention generally relates to a door handle. More particularly, the present invention pertains to a vehicle door handle device having a grip type outside door handle.

BACKGROUND OF THE INVENTION

Japanese Utility Model Publication No. H06-7188 discloses a known vehicle door handle device. This known vehicle door handle device includes a handgrip having a rotation center rotatably fitted into a frame on one end portion and a lock mechanism contacting the one end portion in the direction for inserting the handgrip into the frame. The movement of the handgrip in the inserting direction into the frame is restricted by the lock mechanism. Accordingly, the lock mechanism prevents the dislocation of the one end portion from the frame and the dropping or dislocation of the handgrip from the frame.

However, because the lock mechanism is required in addition to the frame and the handgrip in order to restrict the movement of the handgrip, the number of parts is increased and the structure is relatively complicated. Further, by virtue of assembly errors with respect to assembling the lock mechanism to the frame, the handgrip may have excessive play and may thus generate a chattering noise relative to the frame.

A need thus exists for a vehicle door handle device which is able to restrict excessive play of the handgrip relative to the frame without the same degree of complexity in structure as the known device described above.

SUMMARY OF THE INVENTION

According to one aspect, a vehicle door handle device includes a frame equipped on the door panel of a vehicle door, and a handgrip having a first end portion rotatably mounted on the frame and a second end portion forming an operation portion linked with a door lock mechanism. The handgrip is rotatable within a predetermined angle to operate the door lock mechanism and effect opening of the vehicle door when the operation portion of the handgrip is moved to rotate the handgrip relative to the frame. A projection is formed on one of the frame and the first end portion of the handgrip, while a groove is formed on the other of the frame and the first end portion of the handgrip. The projection is positioned in the groove to move within the groove when the operation portion of the handgrip is moved to rotate the handgrip relative to the frame. The projection is also engageable with a periphery of the groove to inhibit dislocation of the handgrip from the frame.

Another aspect involves a vehicle door handle device having a frame equipped on the door panel of a vehicle door, and a handgrip having a first end portion rotatably mounted on the frame and a second end portion forming an operation portion of the handgrip that is linked with a door lock mechanism, with the handgrip being rotatable within a predetermined angle to operate the door lock mechanism and effect opening of the vehicle door when the operation portion of the handgrip is moved away from the frame to rotate the handgrip relative to the frame. A projection is formed on either the frame or the second end portion of the handgrip, while a groove is formed on the other of the frame and the second end portion of the handgrip. The projection is positioned in the groove to move within the groove when the operation portion of the handgrip is moved away from the frame to rotate the handgrip relative to the frame. The projection is also engageable with the periphery of the groove to inhibit dislocation of the handgrip from the frame.

According to another aspect, a vehicle door handle device includes a frame equipped on the door panel of a vehicle door, and a handgrip mounted on the frame through insertion of the handgrip into the frame in an insertion direction. The handgrip has a first end portion rotatable relative to the frame about a rotation center portion and a second end portion forming an operation portion linked with a door lock mechanism. The handgrip is rotatable relative to the frame within a predetermined angle at the rotation center portion to operate the door lock mechanism and effect opening of the vehicle door when the second end portion is pulled away from the frame. A projection and a groove are provided between the frame and the handgrip, with the projection being positioned in the groove. The projection is movable in the groove in a rotation direction of handgrip and is engageable with a boundary of the groove in the insertion direction of the handgrip.

BRIEF DESCRIPTION OF THE DRAWING FIGURES

The foregoing and additional features and characteristics of the present invention will become more apparent from the following detailed description considered with reference to the accompanying drawing figures in which like reference numerals designate like elements.

DETAILED DESCRIPTION OF THE INVENTION

Figure 1:
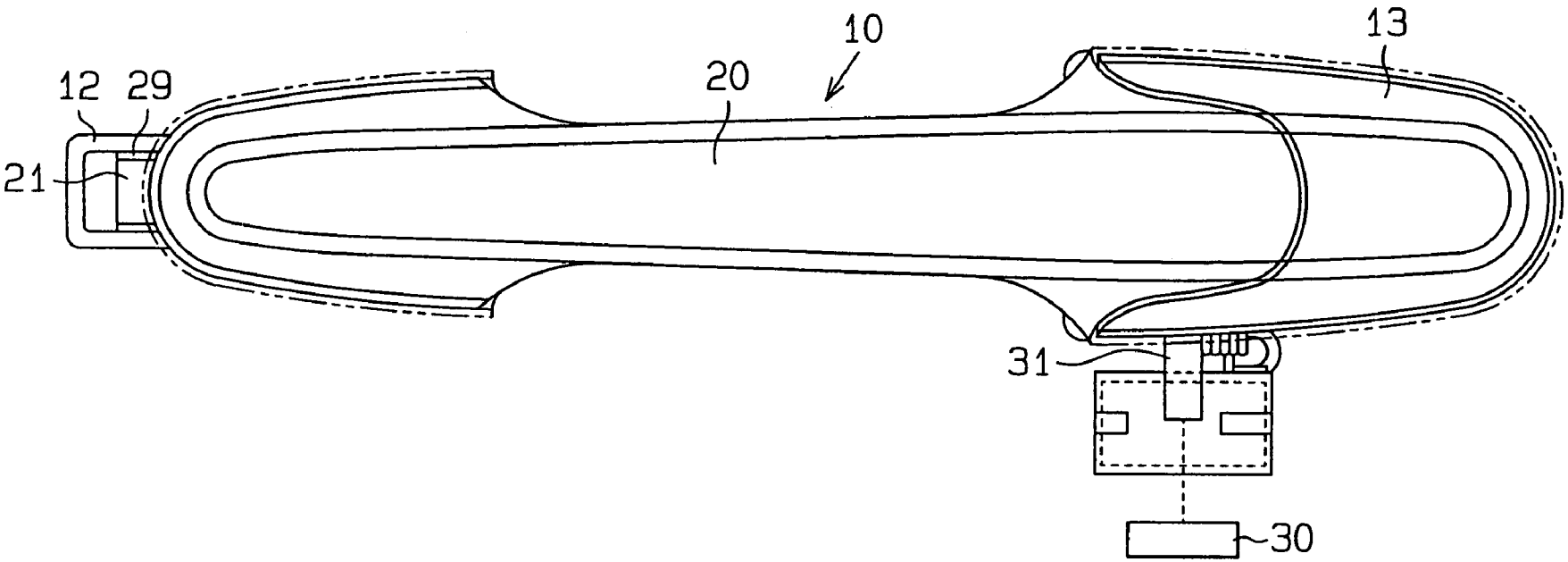
FIG. 1 is a front view of a vehicle door handle device according to a first embodiment of the present invention.
Figure 2:
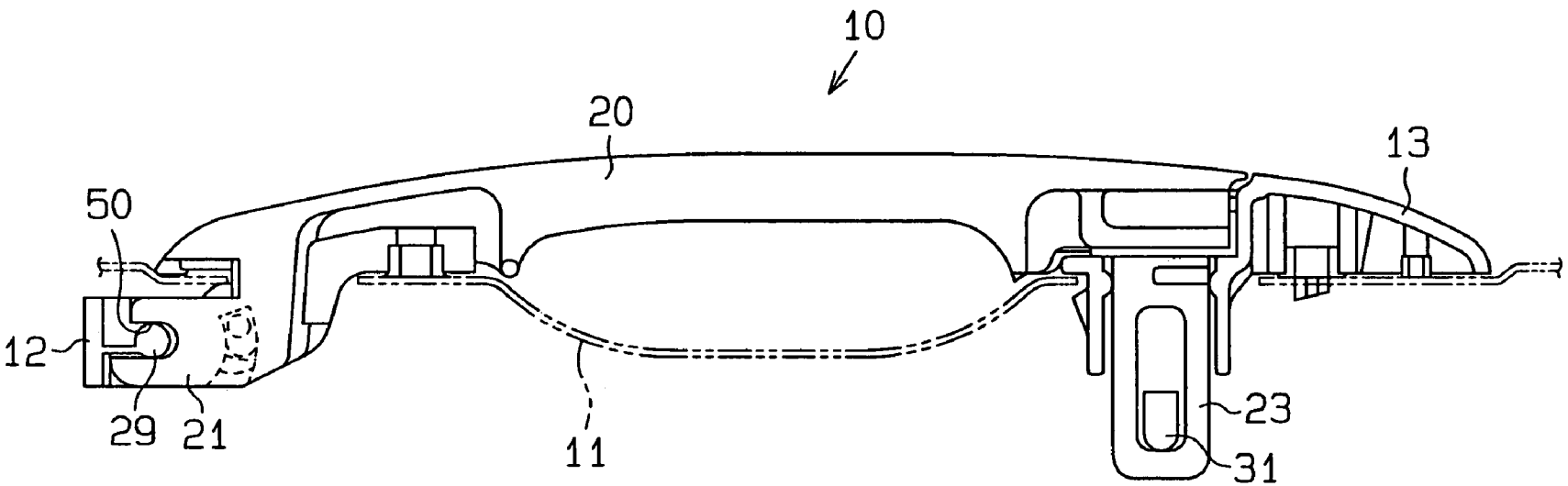
FIG. 2 is a side view, partially in cross-section, of the vehicle door handle device shown in FIG. 1.
Figure 3:
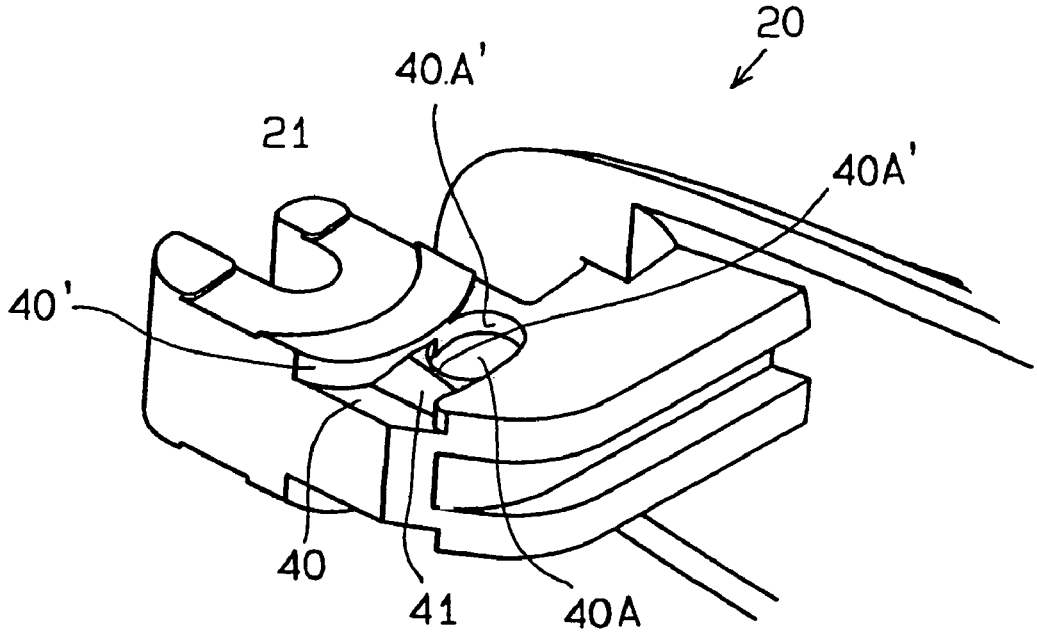
FIG. 3 is a perspective bottom view of one end portion of the handgrip used in the vehicle door handle device shown in FIG. 1.
Figure 4:
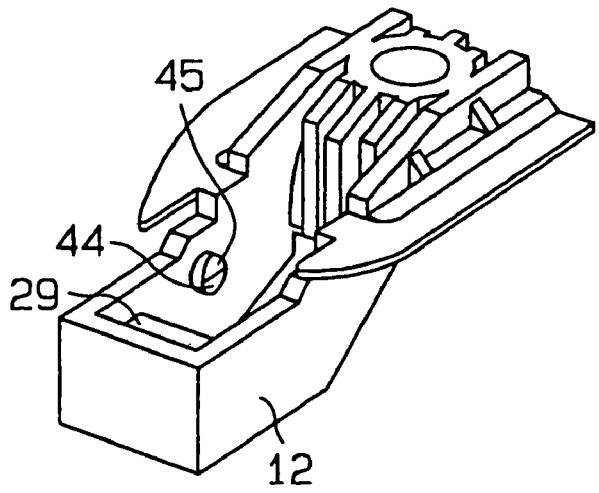
FIG. 4 is a perspective view of a first base member used in the vehicle door handle device shown in FIG. 1.
Figure 5:
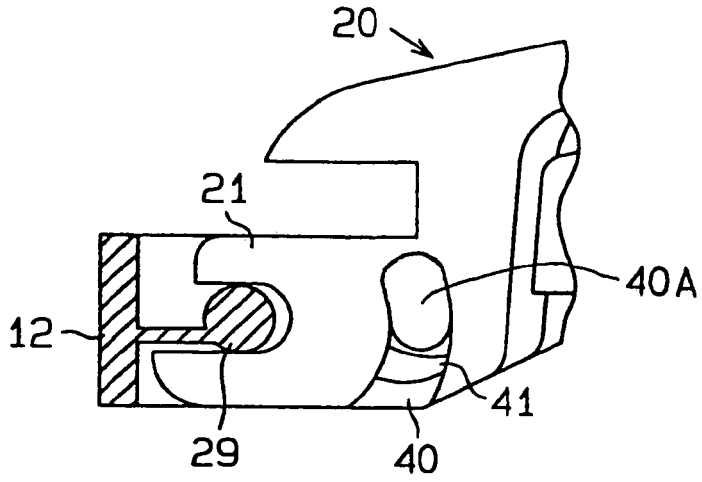
FIG. 5 is a partial cross-sectional view of a main portion of a restriction mechanism used in the vehicle door handle device shown in FIG. 1.

As shown in FIGS. 1 and 2, one embodiment of a vehicle door handle device 10 includes a frame equipped on the door panel 11 of a vehicle door and an elongated handgrip 20. The frame includes a first base member 12 mounted on the vehicle door panel 11 and a second base member 13 mounted on the vehicle door panel 11. The first and second base members 12, 13 are separate from one another and are mounted on the vehicle door panel 11 to maintain a predetermined distance between the two base members 12, 13 in the longitudinal direction of the vehicle (i.e., the right to left direction in FIG. 1). The elongated handgrip 20 extends in the longitudinal direction of the vehicle approximately parallel with the vehicle door panel 11. One end portion of the handgrip 20 (i.e., a first end portion) is operatively connected to the first base member 12 and the other end portion of the handgrip 20 (i.e., a second end portion) is operatively connected to the second base member 13.

The first end portion of the handgrip 20 is provided with an integrally formed L-shaped leg portion 21. The leg portion 21 is provided with a tip portion 50 extending in the first base member 12 and having a U-shaped slotted portion. The leg portion 21 of the handgrip 20 is engaged with a shaft portion 29 that is integrally formed in one piece with an internal portion of the first base member 12. The handgrip 20 is thus rotatable relative to the first base member 12 about a rotation center position. That is, the tip portion 50 of the leg portion 21 rotates around the shaft portion 29.

The second end portion of the handgrip 20 is provided with an integrally formed arm portion 23. The arm portion 23 extends in the second base member 13 and is adapted to be connected or linked to a link mechanism linked or connected to a door lock mechanism 30. Thus, when the second end portion of the handgrip 20 is pulled away from the vehicle door panel 11 in the direction for separating the second end portion of the handgrip 20 from the vehicle door panel 11 (i.e., the upward direction in FIG. 2), the handgrip 20 is rotated within a predetermined angle about the shaft portion 29 to effect opening of the vehicle door.

As shown in FIGS. 2–5, an arc-shaped groove 40 is formed on both side surfaces of the leg portion 21 of the handgrip 20. An inclined plane or inclined surface portion 41 and a fitting portion 40A are formed along each of the arc-shaped grooves 40. In addition, a projection 44 is formed on each of the side surfaces of the first base member 12 so that the projections appose one another. Although FIG. 4 only shows the projection 44 on one of the side surfaces of the first base member 12, it is to be understood that a similar projection is provided on the other side surface of the first base member so that the projections face one another and project towards one another. When assembled, the projections 44 oppose (i.e., are positioned on opposite sides of) the leg portion 21 of the handgrip 20. When the handgrip 20 is rotated in the direction so that the second end portion of the handgrip 20 is pulled close to the vehicle door panel 11 (i.e., the reverse direction of the aforementioned direction in which the second end portion of the handgrip 20 is moved away from the vehicle door panel 11), with the shaft portion 29 serving as the rotation center and the slotted portion in the tip portion 50 of the leg portion 21 of the handgrip 20 receiving the shaft portion 29, the projections 44 climb or move over the corresponding inclined plane or inclined surface portion 41, and then drop or fit into the respective arc-shaped fitting portion 40A. This results in a snap-fit of each projection 44 into the respective fitting portion 40A. To facilitate the projections climbing or moving over the inclined surface 41, a slope 45 is formed on the tip surface of each projection 44.

With the above construction, the leg portion 21 of the handgrip 20 is rotatably fitted in a space (i.e., the space formed as the U-shaped portion in FIG. 1) between the side surfaces or side walls on which the projections 44 of the first base member 12 are formed. The projections 44 are slidably provided in the respective arc-shaped grooves 40 (or the fitting portions 40A of the grooves) formed on the leg portion 21 of the handgrip 20. The center of curvature of the grooves 40 is concentric with the shaft 29 so that the rotation of the handgrip 20, having the shaft 29 as its rotation center, does not substantially experience interference. The arc-shaped grooves 40 and the corresponding projections 44 form a mating engagement in the longitudinal direction of the vehicle. The dislocation of the leg portion 21 of the handgrip 20 from the shaft portion 29 in the longitudinal direction of the vehicle (i.e., the direction of extent of the frame) is prevented by the mating engagement between the projections 44 and the grooves 40 (or the fitting portion 40A of the grooves). That is, the walls 40' of the grooves 40 (or the fitting portions 40A) restrict the movement of the projections 44. Accordingly, the projections 44 and the corresponding arc-shaped grooves 40 (or the fitting portions 40A) together form a mechanism permitting rotation of the handgrip 20, having the shaft portion 29 as its rotation center, while at the same inhibiting or preventing dislocation of the leg portion 21 of the handgrip 20 from the shaft portion 29 in the direction of extent of the frame. This ability to inhibit or prevent dislocation may be particularly useful when the handgrip 20 is mounted to the first base member 12 before being attached to the vehicle, as the engagement of the projections 44 with the walls 40' of the grooves 40 inhibits or prevents the handgrip 20 (i.e., the tip portion 50 of the leg portion 21) from becoming separated from the first base member 12 (i.e, the shaft portion 29) during, for example, delivery to the assembly line.

When the U-shaped slotted portion in the tip portion 50 of the leg portion 21 of the handgrip 20 rotates about the shaft portion 29, the upper limit position and the lower limit position are determined by the position at which the projections 44 engage the upper and lower peripheries 40A', 40A' of the corresponding arc-shaped fitting portions 40A. Accordingly, even when a relatively large load affects or acts on the handgrip 20 in the rotational direction, the handgrip 20 is not dislocated in the rotational direction due to the engagement between the projections 44 and the upper and lower peripheries 40A', 40A' of the arc shaped fitting portions 40A. That is, the arc-shaped fitting portions 40A and the projections 44 function as a limitation mechanism for the rotation range of the handgrip 20.

With the construction described above, a pin forming a rotational center portion is excluded and the rotation center of the handgrip is constituted by the shaft portion 29 which is unitarily formed on the first base member 12. Thus, the number of parts forming the vehicle door handle device is reduced and the assembly operation is simplified. In addition, because the movement of the handgrip in the longitudinal direction of the vehicle (the direction of extent of the frame) is inhibited or restricted by virtue of the restriction mechanism that includes the projections provided between the handgrip and the first base member and the grooves into which the projections are slidably positioned, the dislocation of the handgrip in the longitudinal direction of the vehicle (i.e., the direction of extent of the frame) can be inhibited by virtue of the mating engagement of the projections and the grooves. Chattering can also be inhibited or prevented.

In addition, the restriction mechanism is constructed by the grooves formed on the handgrip side and the projections formed on the first base member side which are slidably received in the respective grooves. The restriction mechanism can thus be relatively easily formed and the rotation range of the handgrip can be defined by the arc-shaped grooves and the projections.

Figure 6:
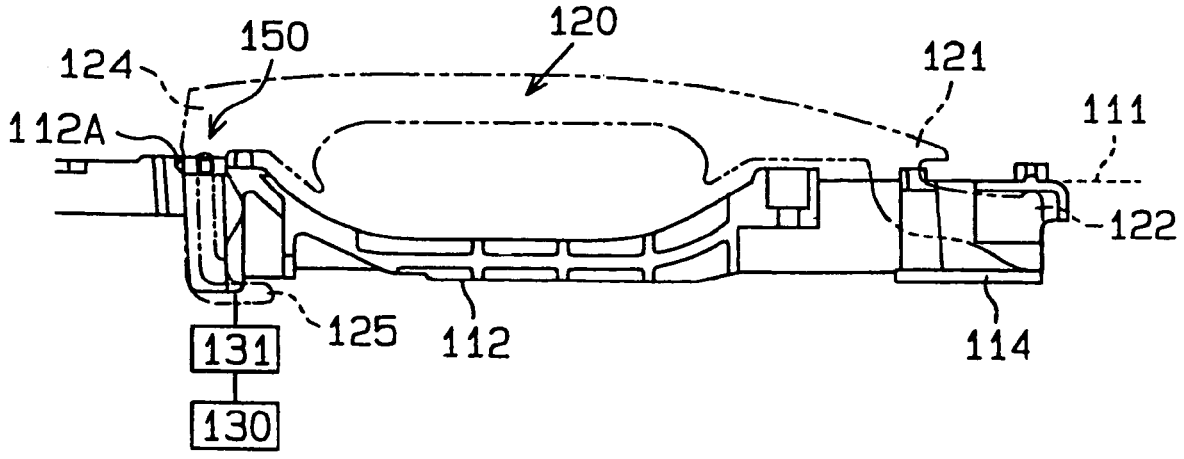
FIG. 6 is a side view of a vehicle door handle device according to a second embodiment of the present invention.
Figure 7:
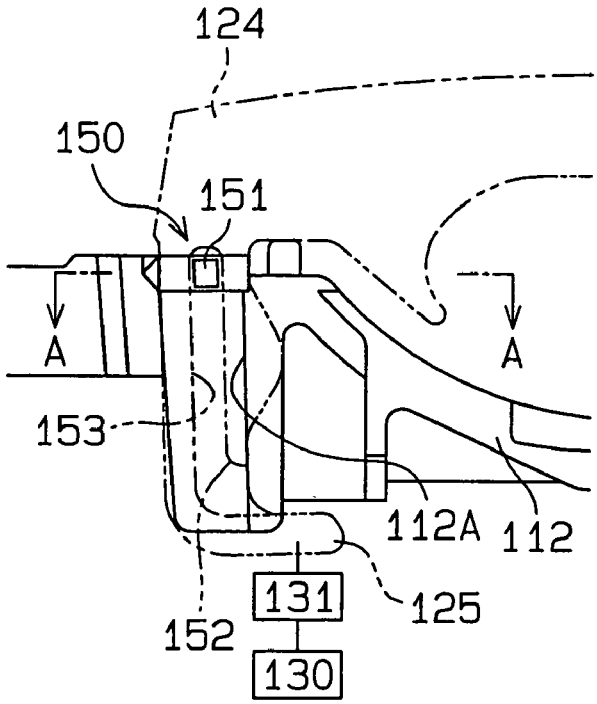
FIG. 7 is an enlarged side view of a portion of the vehicle door handle device shown in FIG. 6 illustrating the restriction mechanism.
Figure 8:
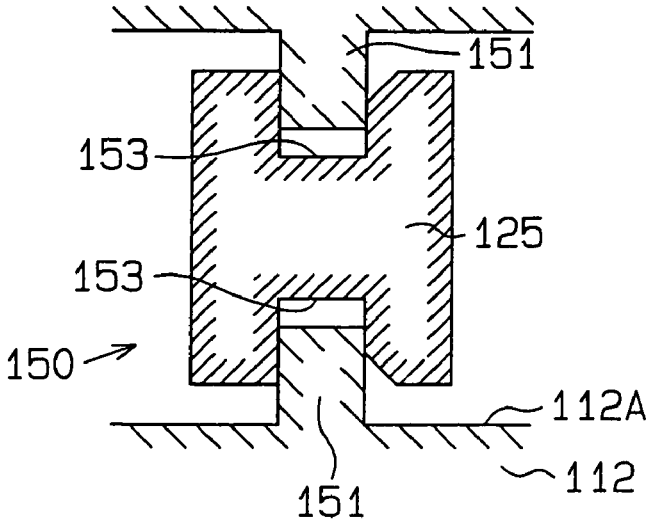
FIG. 8 is a cross-sectional view taken along the section line VIII—VIII in the FIG. 7.
Figure 9:
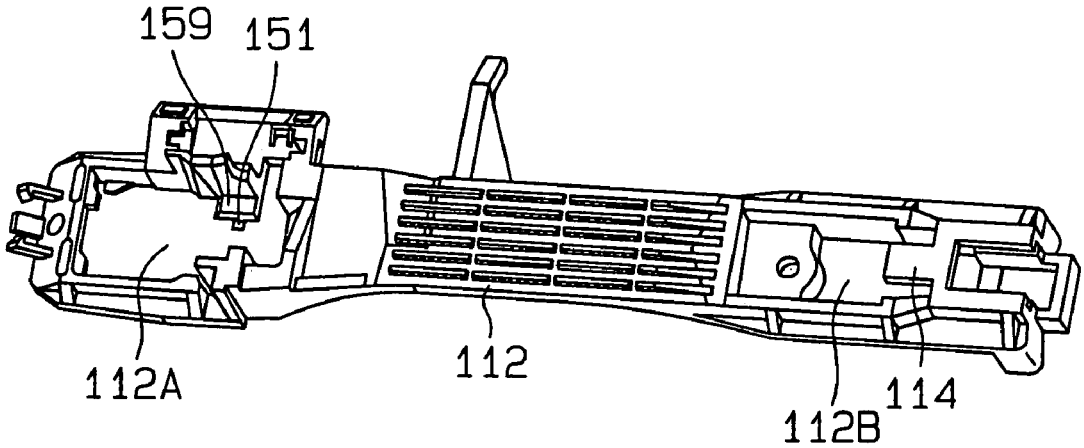
FIG. 9 is a rear perspective view of the frame used in the vehicle door handle device shown in FIG. 6.
Figure 10:
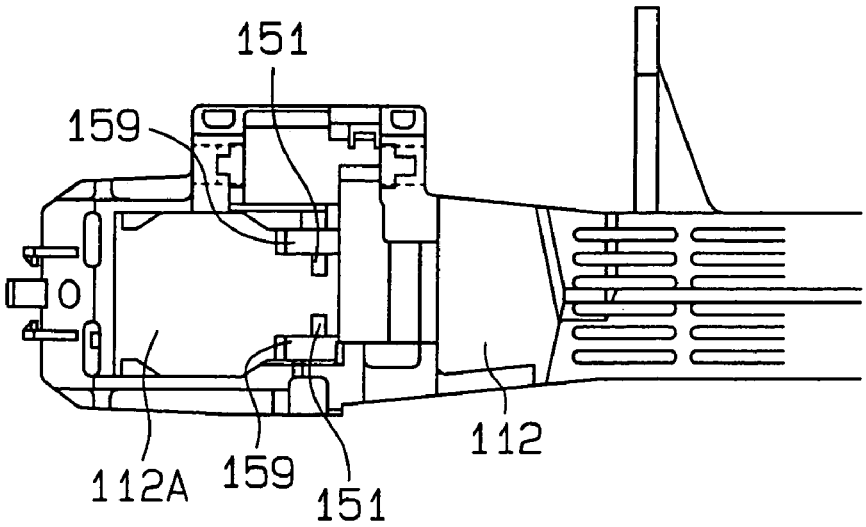
FIG. 10 is a plane view of a portion of the frame shown in FIG. 9.

Another embodiment of the vehicle door handle device is shown in FIGS. 6–11. As shown in FIG. 6, a vehicle door handle includes a frame 112 equipped on the inside of a vehicle door panel 111 and extending in the longitudinal direction of the vehicle (i.e., the right to left direction of FIG. 6). A handgrip 120 is provided on the outside of the vehicle door panel 111. An L-shaped leg portion 121 is formed on one end portion or the first end portion of the handgrip 120 (i.e., the right end portion of the handgrip 20 as seen with reference to FIG. 6). The leg portion 121 extends into the vehicle door panel 111 through an insertion bore and through a hole 112B formed on one end portion of the frame 112 so as to be rotatably inserted into a supporting portion 114 provided on the frame 112. A part of the leg portion 121 of the handgrip 120 is defined as a rotation center portion 122 of the handgrip.

An L shaped arm portion 125 is formed on the other end portion or second end portion 124 of the handgrip 120 (i.e., the left end portion of the handgrip 20 as seen with reference to FIG. 6). The arm portion 125 extends into the vehicle door panel 111 through an insertion bore and through a hole 112A formed on the other end portion of the frame 112 (i.e., the left end portion of the frame 112 in FIG. 6) so as to be connected or linked to a link mechanism 131 which is linked or connected to a door lock mechanism 130. When the second end portion 124 of the handgrip 120 is pulled outwardly away from the vehicle door panel 111 (i.e., in the upward direction of FIG. 6), the handgrip 120 rotates around the rotational center portion 122 within a predetermined range to operate the door lock mechanism 130 and effect opening of the vehicle door.

A restriction mechanism 150 is provided between the arm portion 125 of the handgrip 120 and the frame 112. The restriction mechanism 150 restricts the movement of the handgrip 120 in the direction of extent of the frame 112 (i.e., the longitudinal direction of the vehicle which is the inserting direction of the leg portion 121 of the handgrip 120) while also allowing rotation of the handgrip 120.

As shown in FIGS. 7–11, the restriction mechanism 150 includes a pair of projections 151, 151 extending from the internal periphery or inner walls of the hole 112A formed in the frame 112 and a pair of grooves 153, 153 formed on the arm portion 125 of the handgrip 120. The projections 151, 151 are positioned in opposition to one another and project towards each other. Each of the projections 151, 151 is slidably fitted or engaged with a respective one of the grooves 153, 153. A base portion of each projection 151 is provided with a boss 159.

Figure 11:
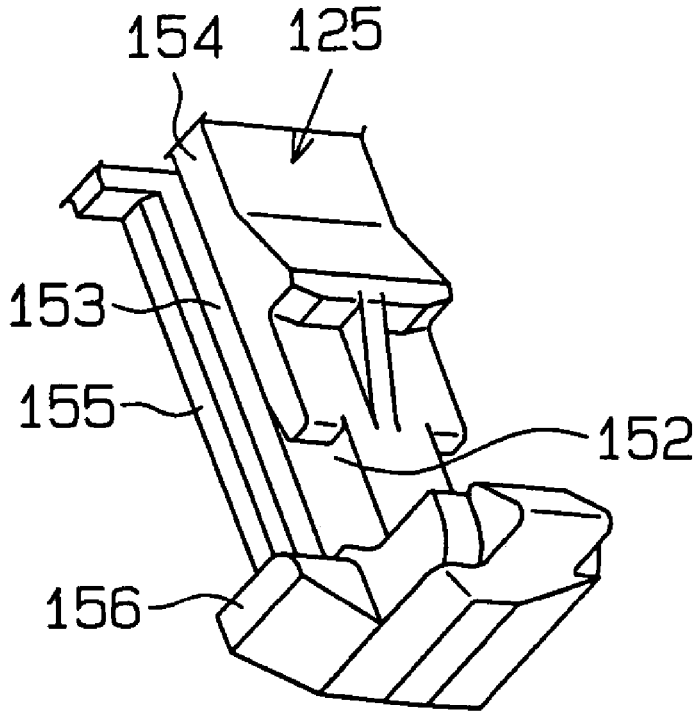
FIG. 11 is a enlarged perspective view of the operation portion of the handgrip used in the vehicle door handle device shown in FIG. 6.

As shown in FIG. 11, the grooves 153, 153 are L-shaped grooves formed on each side surface of the arm portion 125 of the handgrip 120. The bottom end portion of each groove 153, 153 (i.e., the bottom end portion shown in FIG. 11) opens rightward as seen with reference to FIG. 11 in a direction corresponding to the inserting direction of the leg portion 121. The bottom end portion of each groove thus forms an opening 152 which is illustrated in FIG. 11. The grooves 153 are formed by facing walls 154, 155 which are opposed to each other in the longitudinal direction (i.e., the inserting direction of the leg portion 121) of the vehicle. As shown in FIG. 11, the bottom end portion of each wall 155 is connected to a projecting portion 156 that is unitarily formed on the arm portion 125.

When the operation portion of the handgrip is moved outwardly away from the vehicle door panel to rotate the handgrip 120, the movement of the arm portion 125 of the handgrip 120 is guided by the pair of projections 151, 151 on the frame 112 which engage and are guided along the respective grooves 153, 153. When the rotational amount of the handgrip 120 reaches a predetermined amount, the projecting portions 156 which move together as a unit with the handgrip 120 each engage the respective boss 159 to restrict further rotation of the handgrip 20. The movement of the handgrip 120 in the direction of extent of the frame 112, that is the inserting direction of the leg portion 121 (i.e., the right to left direction in FIGS. 6–8), is restricted or inhibited by the contact or engagement of the projections 151, 151 on the frame 112 with the walls 154, 155 of the arm portion 125. Thus, possible chattering of the handgrip 120 in the direction of extent of the frame 112 is inhibited or prevented.

The door handle device described above and illustrated in FIGS. 6–11 is assembled in the following manner. First, the leg portion 121 formed on the first end portion (i.e., the right end portion in FIG. 6) of the handgrip 120 is inserted into the hole 112B formed on the one end (i.e., the right end portion) of the frame 112 after passing through the bore in the vehicle door panel 111. At this point, the leg portion 121 formed on first end portion of the handgrip 120 is not completely inserted and fitted in the supporting portion 114 provided on the frame 112.

Next, the leg portion 125 formed on the second end portion (i.e., the left end portion in FIG. 6) 124 of the handgrip 120 is inserted into the hole 112A at the other end portion (i.e., the left end portion) of the frame 112. Then, the handgrip 120 is moved rightward, which is the inserting direction of the leg portion 121. With this rightward movement of the handgrip 120, the leg portion 121 at the one end portion of the handgrip 120 is completely inserted and fitted into the supporting portion 114 of the frame 112. In addition, each of the projections 151, 151 is slidably inserted from the opening 152 into the respective groove 153, 153. By aligning the bottom end portion of the grooves 153, 153 to the corresponding projection 151, 151 and pushing the arm 125 relative to the frame 112, each groove 153 slides along the corresponding projection 151, 151. The sliding movement is completed when the wall at the upward end portion of each groove 153 shown in FIG. 11 engages the boss 159 associated with the respective projection 159. The leg portion 121 at the one end portion of the handgrip 120 is thus rotatably supported in the supporting portion 114 around the rotation center portion 122. In this case, the projecting portions 156 unitary formed at the bottom end portion of the arm portion 125 face the respective bosses 159.

When the handgrip 120 is rotated to operate the door lock mechanism to effect opening of the vehicle door, the arm portion 125 of the handgrip 120 is guided by the pair of projections 151, 151 on the frame 112 which move within the respective grooves 153, 153. When the amount of rotation of the handgrip 120 reaches a predetermined value, the projections 156, 156 which move outwardly (i.e., in the upward direction of FIG. 6) together with the handgrip 120 engage the respective bosses 159 to prevent dislocation of the handgrip 120. In addition, movement of the handgrip 120 in the direction of extent of the frame 120, that is the inserting direction of the leg portion 121 (i.e., the right to left direction of FIGS. 6–8) is inhibited or prevented by the pair of projections 151, 151 on the frame 112 being positioned between the walls 154, 155 bounding the grooves 153, 153. Chattering of the handgrip 120 is thus also inhibited or prevented.

In this second embodiment of the vehicle door handle device, the inhibition of prevention of chattering of the handgrip is directly performed between the handgrip and the frame by virtue of the restriction mechanism comprised of the projections and the grooves. Thus, chattering of the handgrip relative to the frame in the inserting direction can be securely controlled with a relatively simple structure and without increasing the number of parts forming the vehicle door handle device.

With the described embodiments of the vehicle door handle device, when the handgrip is outwardly away from the frame, the handgrip is rotated around the rotation center portion to operate the door lock mechanism. However, the movement of the handgrip in the direction of insertion of the handgrip into the frame or in the direction of extent of the frame is inhibited or restricted by the restriction mechanism formed by the projections and the grooves. Thus, potential chattering and/or dislocation of the handgrip relative to the frame can be controlled with a relatively simple structure comprised of the projections and the grooves.

More specifically, potential chattering and/or dislocation of the handgrip relative to the frame is inhibited or restricted by the projections and the grooves formed on the first base member (frame) and the one end portion (operation portion) of the handgrip. Thus, possible chattering and/or dislocation of the handgrip relative to the frame can be restricted with a relatively simple construction formed by the projections and the grooves.

In addition, as described above, the projections are engaged with the grooves via the opening portion. The direction of the opening portion corresponds to the inserting direction of the handgrip, or the leg portion of the handgrip, into the frame. Thus, the projections can be engaged with the grooves when inserting the handgrip into the frame for assembly, thus improving the assembly efficiency.

The principles, preferred embodiments and modes of operation of the vehicle door handle device have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes, and equivalents which fall within the apart and scope of the present invention as defined in the claims, be embraced thereby.

What is claimed is:

1. A vehicle door handle device comprising:

a frame equipped on a door panel of a vehicle door;

a handgrip having a first end portion rotatably mounted on the frame and a second end portion forming an operation portion of the handgrip that is linked with a door lock mechanism, the handgrip being rotatable within a predetermined angle to operate the door lock mechanism and effect opening of the vehicle door when the operation portion of the handgrip is moved away from the frame to rotate the handgrip relative to the frame;

an arm portion formed at the second end portion of the handgrip;

a pair of grooves formed along an extending direction of the arm portion formed on the handgrip;

a hole formed on the frame;

a pair of projections formed extending from inner walls of the hole, the projections positioned in opposition to one another and projecting towards each other; and the projections being positioned in the grooves to move within the grooves when the operation portion of the handgrip is moved away from the frame to rotate the handgrip relative to the frame, the projections being engageable with peripheries of the grooves to inhibit dislocation of the handgrip from the frame;

the arm portion being provided with a projecting portion at one end of the grooves that engages a portion of the frame to define a limit of the predetermined angle when the operation portion of the handgrip is moved away from the frame; wherein the handgrip is engaged with the frame by enabling the arm portion to pass through the hole when the projections are positioned and moved through the grooves.

2. The door handle device according to claim 1, wherein the first end portion of the handgrip is provided with a leg portion insertable into a supporting portion of the frame to define a rotation center portion of the handgrip, the leg portion of the handgrip being inserted in an inserting direction to be completely inserted into the supporting portion of the frame, one end of the groove being open in the inserting direction.

3. The vehicle door handle device according to claim 1, wherein the projections are formed at the hole of the frame via respective bosses.

4. The vehicle door handle device according to claim 1, wherein the grooves are formed between two walls formed at the second end portion of the hand grip, and the walls are connected to a projecting portion formed on the arm portion.

5. A vehicle door handle device comprising:

a frame equipped on a door panel of a vehicle door;

a handgrip having a first end portion rotatably mounted on the frame and a second end portion forming an operation portion of the handgrip that is linked with a door lock mechanism, the handgrip being rotatable within a predetermined angle to operate the door lock mechanism and effect opening of the vehicle door when the operation portion of the handgrip is moved away from the frame to rotate the handgrip relative to the frame;

an arm portion formed at the second end portion of the handgrip;

a pair of grooves formed along an extending direction of the arm portion formed on the handgrip, wherein the grooves are configured in an L-shape, and an end portion of each groove opens;

a hole formed on the frame;

a pair of projections formed extending from inner walls of the hole, the projections positioned in opposition to one another and projecting towards each other; and the projections being positioned in the grooves to move within the grooves when the operation portion of the handgrip is moved away from the frame to rotate the handgrip relative to the frame, the projections being engageable with peripheries of the grooves to inhibit dislocation of the handgrip from the frame; wherein the handgrip is engaged with the frame by enabling the arm portion to pass through the hole when the projections are positioned and moved through the grooves.

6. The door handle device according to claim 5, wherein the first end portion of the handgrip is provided with a leg portion insertable into a supporting portion of the frame to define a rotation center portion of the handgrip, the leg portion of the handgrip being inserted in an inserting direction to be completely inserted into the supporting portion of the frame, the one portion of each groove being open in the inserting direction.

7. The vehicle door handle device according to claim 5, wherein the projections are formed at the hole of the frame via respective bosses.

8. The vehicle door handle device according to claim 5, wherein the grooves are formed between two walls formed at the second end portion of the hand grip, and the walls are connected to a projecting portion formed on the arm portion.

* * * * *